US010207885B2

(12) United States Patent
Udagawa

(10) Patent No.: US 10,207,885 B2
(45) Date of Patent: Feb. 19, 2019

(54) MEDIUM TRANSPORT APPARATUS, MEDIUM FEEDER, AND IMAGE FORMATION SYSTEM

(71) Applicant: Oki Data Corporation, Tokyo (JP)

(72) Inventor: Hiroshi Udagawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 2 days.

(21) Appl. No.: 15/680,396

(22) Filed: Aug. 18, 2017

(65) Prior Publication Data

US 2018/0059609 A1 Mar. 1, 2018

(30) Foreign Application Priority Data

Aug. 31, 2016 (JP) ..... 2016-169284

(51) Int. Cl.

| | |
|---|---|
| ***B65H 5/02*** | (2006.01) |
| ***B65H 11/00*** | (2006.01) |
| ***B65H 5/04*** | (2006.01) |
| ***G03G 15/00*** | (2006.01) |
| ***G03G 21/16*** | (2006.01) |

(52) U.S. Cl.

CPC ..... *B65H 11/002* (2013.01); *B65H 5/021* (2013.01); *B65H 5/04* (2013.01); *G03G 15/6511* (2013.01); *G03G 15/6529* (2013.01); *G03G 21/1695* (2013.01); *B65H 2404/2615* (2013.01); *B65H 2404/2641* (2013.01); *B65H 2404/2693* (2013.01); *B65H 2405/312* (2013.01); *B65H 2407/21* (2013.01); *G03G 2221/1696* (2013.01)

(58) Field of Classification Search

CPC ..... B65H 2407/21; B65H 11/002; B65H 2405/312; B65H 5/021; B65H 5/04; B65H 2404/2615; B65H 2404/2693; B65H 2404/2641; B65H 5/023; B65H 5/025; B65H 5/026; B65H 3/042

See application file for complete search history.

(56) References Cited

U.S. PATENT DOCUMENTS 5,074,540 A * 12/1991 Belec ..... B65H 3/04 271/177
5,617,804 A * 4/1997 Savio ..... B65G 47/648 112/304
5,803,450 A * 9/1998 Brokate ..... B65H 5/023 271/202
6,457,709 B1 * 10/2002 Madsen ..... B65H 5/021 271/198

(Continued)

*Primary Examiner* — Jeremy R Severson

(74) *Attorney, Agent, or Firm* — Metrolexis Law Group, PLLC

(57) ABSTRACT

A medium transport apparatus includes: a frame; a table including a placement surface on which a medium is placed, a first end portion, and a second end portion, the table extending from the first end portion to the second end portion and being rotatable about a first shaft portion parallel to the placement surface; a first rotor arranged adjacent to the first end portion of the table; a second rotor arranged adjacent to the second end portion of the table; a belt that is stretched by the first rotor and the second rotor, and is configured to rotate circularly and to transport the medium in a first direction from the first end portion toward the second end portion; and a biasing part that links the frame and an attachment part provided between the second end portion and the first end portion of the table, and that biases the table.

16 Claims, 11 Drawing Sheets

(56) References Cited

U.S. PATENT DOCUMENTS

| | | | | |
|---|---|---|---|---|
| 7,048,111 | B2 * | 5/2006 | Christofferson | B65H 5/021<br>198/644 |
| 7,384,041 | B2 * | 6/2008 | Flickner | B65H 7/02<br>271/2 |
| 7,623,816 | B2 * | 11/2009 | Maki | B65G 15/64<br>399/163 |
| 8,490,964 | B2 * | 7/2013 | Kaiping | B65H 3/042<br>271/9.09 |
| 8,702,091 | B2 * | 4/2014 | Schmidt | B65H 1/06<br>271/10.06 |
| 2002/0041804 | A1 * | 4/2002 | Cooper | B65G 59/068<br>414/795.7 |

* cited by examiner

MEDIUM TRANSPORT APPARATUS, MEDIUM FEEDER, AND IMAGE FORMATION SYSTEM

CROSS REFERENCE TO RELATED APPLICATIONS

This application claims priority based on 35 USC 119 from prior Japanese patent application no. 2016-169284 filed on Aug. 31, 2016, the entire contents of which are incorporated herein by reference.

BACKGROUND

The disclosure relates to an image formation system which forms an image on a medium, and a medium transport apparatus and a medium feeder which are installed in the image formation system.

Some of image formation apparatuses, such as copiers, printers and facsimile machines, are designed such that an external medium feeder is attachable to them. An external medium feeder is attached to an attachment section of an image formation apparatus before print operation (see Patent Document 1: U.S. Pat. No. 8,490,964, for example).

SUMMARY

An operation of attaching the medium feeder to the image formation apparatus is desired to be done smoothly while avoiding their collision.

To this end, there are demands for: a medium feeder smoothly attachable to an image formation apparatus; an image formation system including such a medium feeder; and a medium transport apparatus suitable for the medium feeder and the image formation system.

A medium transport apparatus in one or more embodiments may include: a frame; a table including a placement surface on which a medium is placed, a first end portion, and a second end portion, the table extending from the first end portion to the second end portion and being rotatable about a first shaft portion parallel to the placement surface; a first rotor arranged adjacent to the first end portion of the table; a second rotor arranged adjacent to the second end portion of the table; a belt that is stretched by the first rotor and the second rotor, and is configured to rotate circularly and to transport the medium in a first direction from the first end portion toward the second end portion; and a biasing part that links the frame and an attachment part provided between the second end portion and the first end portion of the table, and that biases the table.

A medium feeder in one or more embodiments may include: a medium separator including a stacker that holds media as stacked one on another, and a separation part that separates the media one by one, and a medium transport apparatus that transports a medium separated from the media by the medium separator. The medium transport apparatus includes: a frame; a table including a placement surface on which the medium is placed, a first end portion and a second end portion, the table extending from the first end portion to the second portion and being rotatable about a first shaft portion parallel to the placement surface; a first rotor arranged adjacent to the first end portion of the table; a second rotor arranged adjacent to the second end portion of the table; a belt that is stretched by the first rotor and the second rotor, and is configured to rotate circularly and to transport the medium in a first direction from the first end portion toward the second end portion; and a biasing part that links the frame and an attachment part between the second end portion and the first end portion of the table, and that biases the table. In addition, an image formation system in one or more embodiments may include: a medium feeder; and an image formation apparatus. The medium feeder includes: a medium separator includes: a stacker that holds media as stacked one on another, and a separation part that separates a medium from the media on a one-by-one basis, and a medium transport apparatus that transports the medium separated from the media by the medium separator, and the medium transport apparatus includes: a frame, a table including a placement surface on which the medium is placed, a first end portion and a second end portion, the table extending from the first end portion to the second portion and being rotatable about a first shaft portion parallel to the placement surface, a first rotor arranged adjacent to the first end portion of the table, a second rotor arranged adjacent to the second end portion of the table, a belt that is stretched by the first rotor and the second rotor, and is configured to rotate circularly and to transport the medium in a first direction from the first end portion toward the second end portion, and a biasing part that links the frame and an attachment part located between the second end portion and the first end portion in the table and which biases the table.

In the medium transport apparatus, the medium feeder and the image formation system as one or more embodiments may include the biasing part which biases part of the table upward. Accordingly, even in a case where the table is bulky in size and weight, the table can be attached to an attached part of the image formation apparatus relatively easily while avoiding the table's unnecessary collision with surroundings.

The medium transport apparatus and the medium feeder as one or more embodiments can be smoothly attached to the image formation apparatus. In addition, the image formation apparatus as one or more embodiments enables such a medium transport apparatus and such a medium feeder to be smoothly attached to the image formation apparatus.

DETAILED DESCRIPTION

Figure 1:
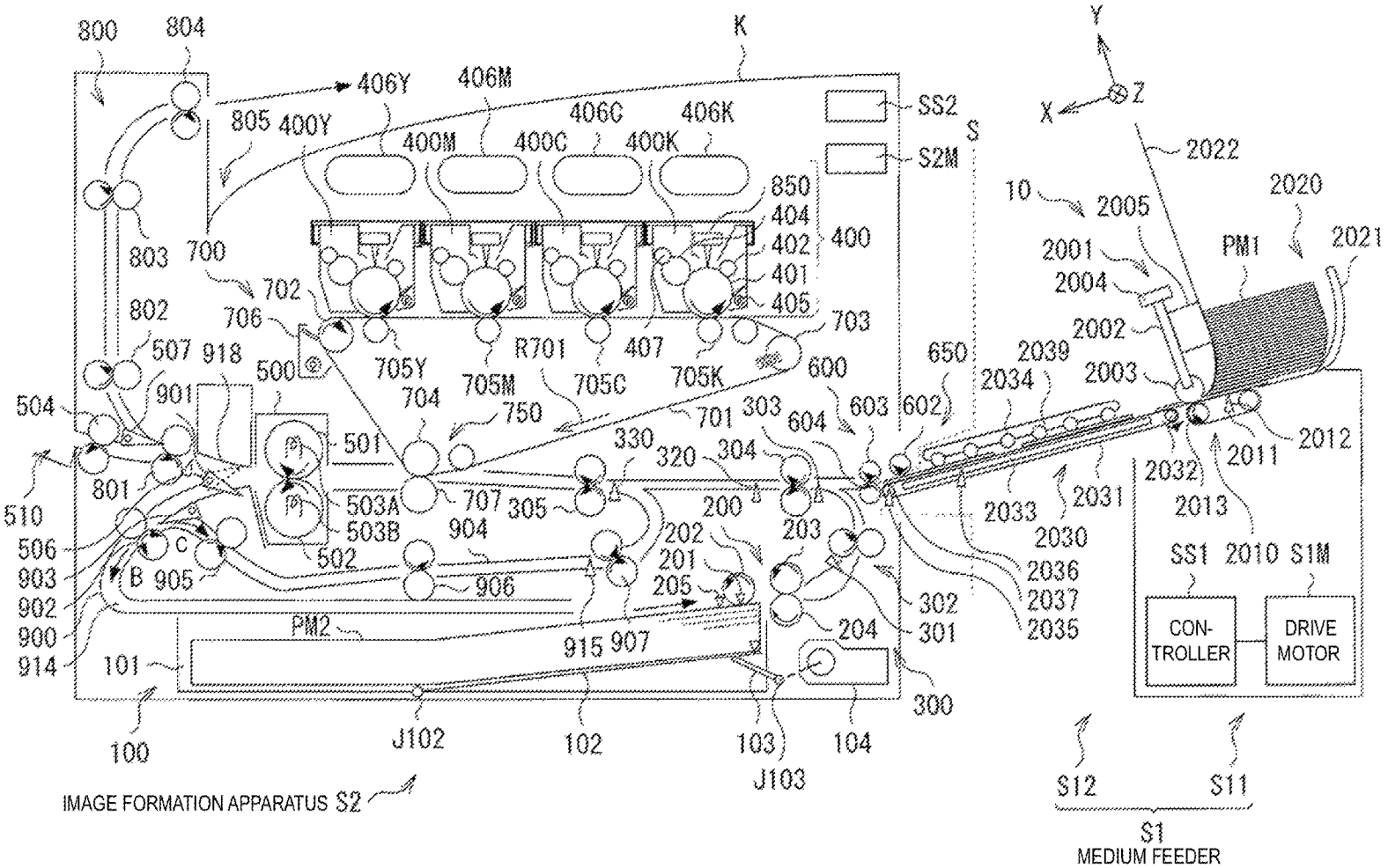
FIG. 1 is a schematic view illustrating an example of an overall configuration of an image formation system according to one or more embodiments.

Embodiments of the invention are hereinbelow explained in detail with reference to drawings. Incidentally, the following explanations are provided for one specific example of the invention. The invention is not limited to the below-explained aspects. In addition, the invention is not limited by arrangements, dimensions, dimensional ratios and the like of the components illustrated in the drawings. The explanations are provided in the following sequence.

1. One embodiment (Medium Transport Apparatus, as well as Medium Feeder and Image Formation System in which Medium Transport Apparatus is Installed)
1.1 Overall Configuration of Image Formation System
1.2 Detailed Configuration of Medium Feeder
1.3 Detailed Configuration of Image Formation Apparatus
1.4 Working/Effects of Image Formation System
2. Modifications

1. One Embodiment

[1.1 Overall Configuration of Image Formation System]

Figure 2:
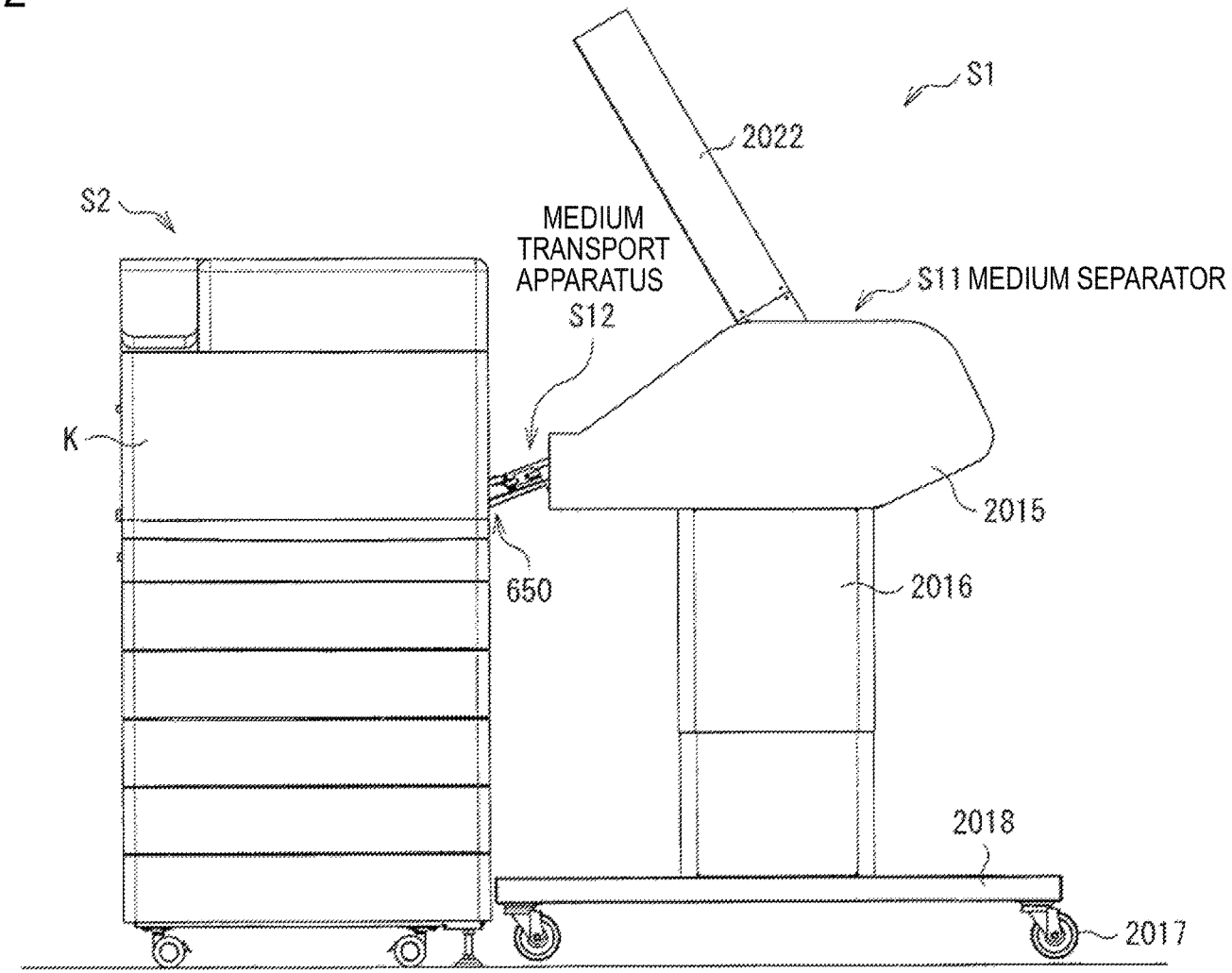
FIG. 2 is a front view illustrating an outer appearance of the image formation system illustrated in FIG. 1.
Figure 3:
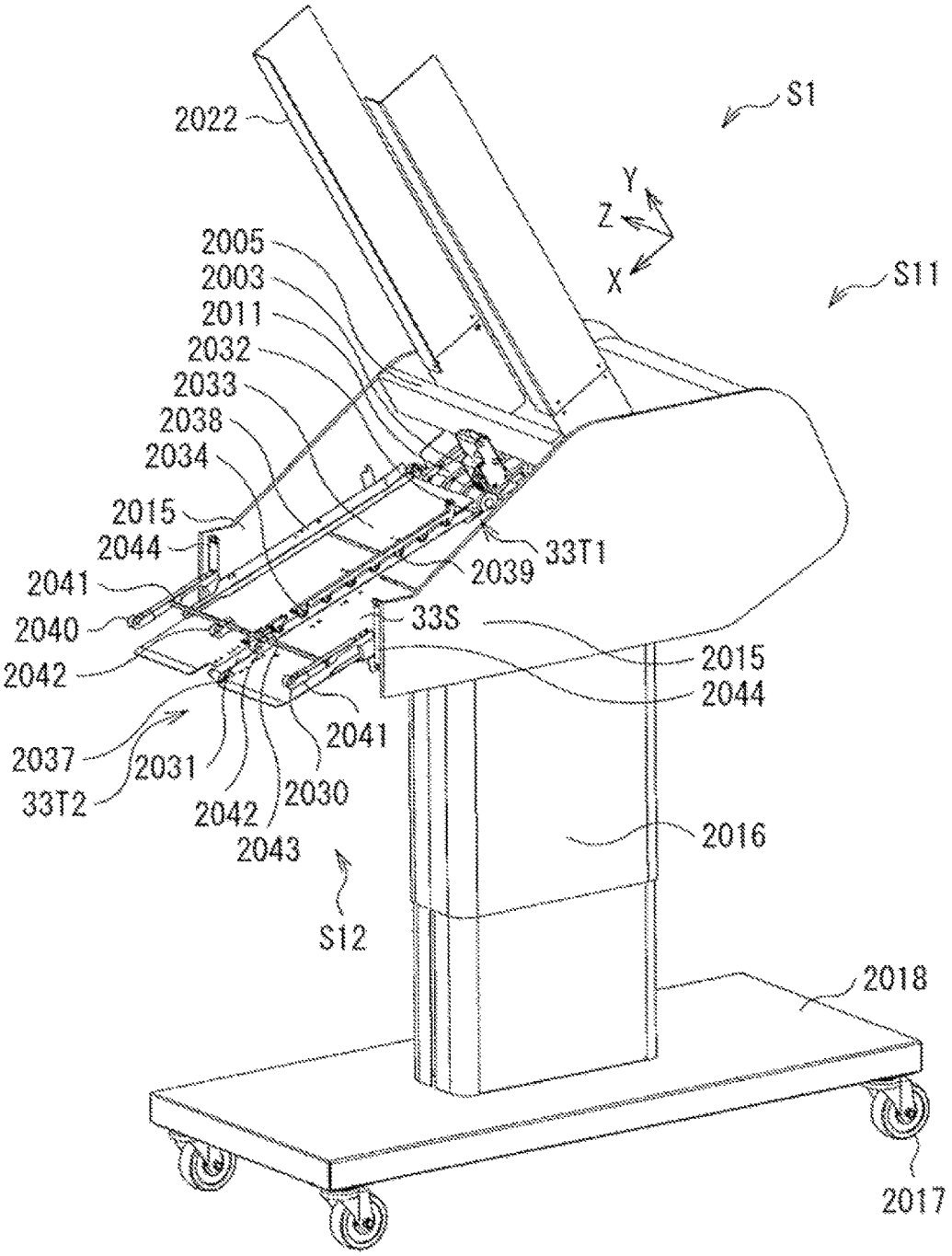
FIG. 3 is a perspective view illustrating an outer appearance of a medium feeder illustrated in FIG. 1.
Figure 4:
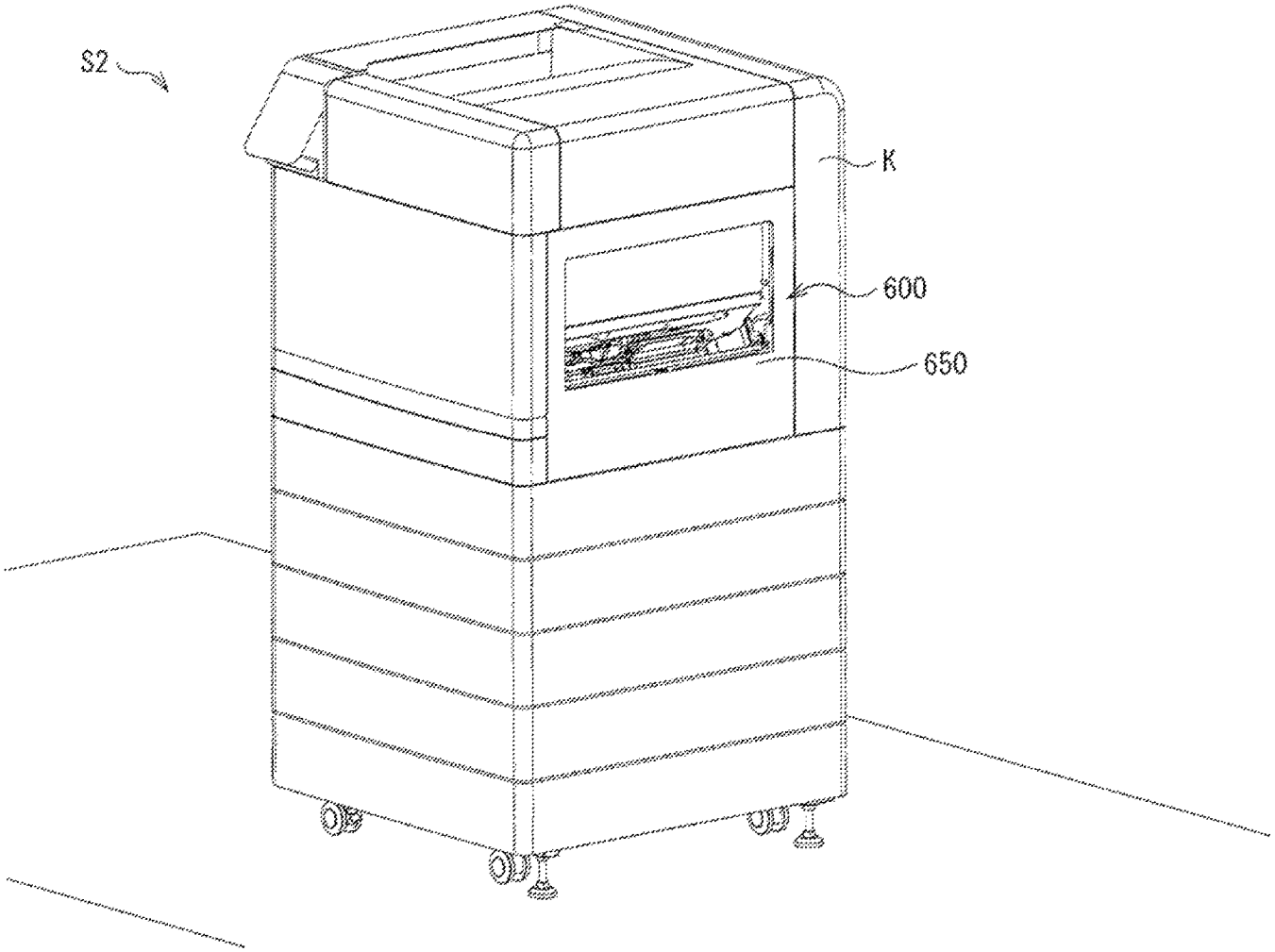
FIG. 4 is a perspective view illustrating an outer appearance of an image formation apparatus illustrated in FIG. 1.

FIG. 1 is a schematic view illustrating an example of an overall configuration of an image formation system according to one or more embodiments. FIG. 2 is a front view illustrating an outer appearance of the image formation system. The image formation system corresponds to a specific example of the "image formation system" in one or more embodiments, and includes medium feeder S1 and image formation apparatus S2. FIG. 3 is a perspective view illustrating an example of an overall configuration of medium feeder S1 illustrated in FIGS. 1 and 2. FIG. 4 is a perspective view illustrating an example of an overall configuration of image formation apparatus S2. Medium feeder S1 corresponds to a specific example of the "medium feeder" in one or more embodiments, and includes medium separator S11, medium transport apparatus S12, controller SS1, and drive motor S1M. Medium separator S11 and medium transport apparatus S12 share common frame 2015. In medium feeder S1, frame 2015 is vertically movably provided to pedestal 2018 with casters 2017 via stand section 2016. Since medium feeder S1 is provided with casters 2017, medium feeder S1 is horizontally movable on the floor. Medium separator S11 includes: stacker 2020 which holds media PM1 as stacked one on another; and separation part 10 (FIG. 10) which separates media PM1 on a one-by-one basis. Medium transport apparatus S12 is located downstream of medium separator S11, and transports media PM1, after separated by medium separator S11, to image formation apparatus S2 which is located downstream of medium transport apparatus S12. Incidentally, in this specification, an arbitrary position is used as a reference; a direction from the arbitrary position toward stacker 2020 and a position closer to stacker 2020 than the arbitrary position is are referred to as upstream or rearward; and a direction of becoming farther from stacker 2020 than from the arbitrary position and a position farther from stacker 2020 than from the arbitrary position are referred to as downstream or frontward. In the image formation system, stacker 2020 is located in the most upstream position. Image formation apparatus S2 includes housing K. A side surface of housing K is provided with opening 650 of attached part 600. Medium transport apparatus S12 is attached to attached part 600 with a distal end portion of medium transport apparatus S12 inserted into opening 650. In addition, controller SS1 controls the entirety of medium feeder S1 in cooperation with controller SS2 (described later) of image formation apparatus S2. Based on an instruction from controller SS1, drive motor S1M functions as a drive source for later-described feed transport section 2010 and medium transport apparatus S12.

[1.2 Detailed Configuration of Medium Feeder S1]

Figure 5:
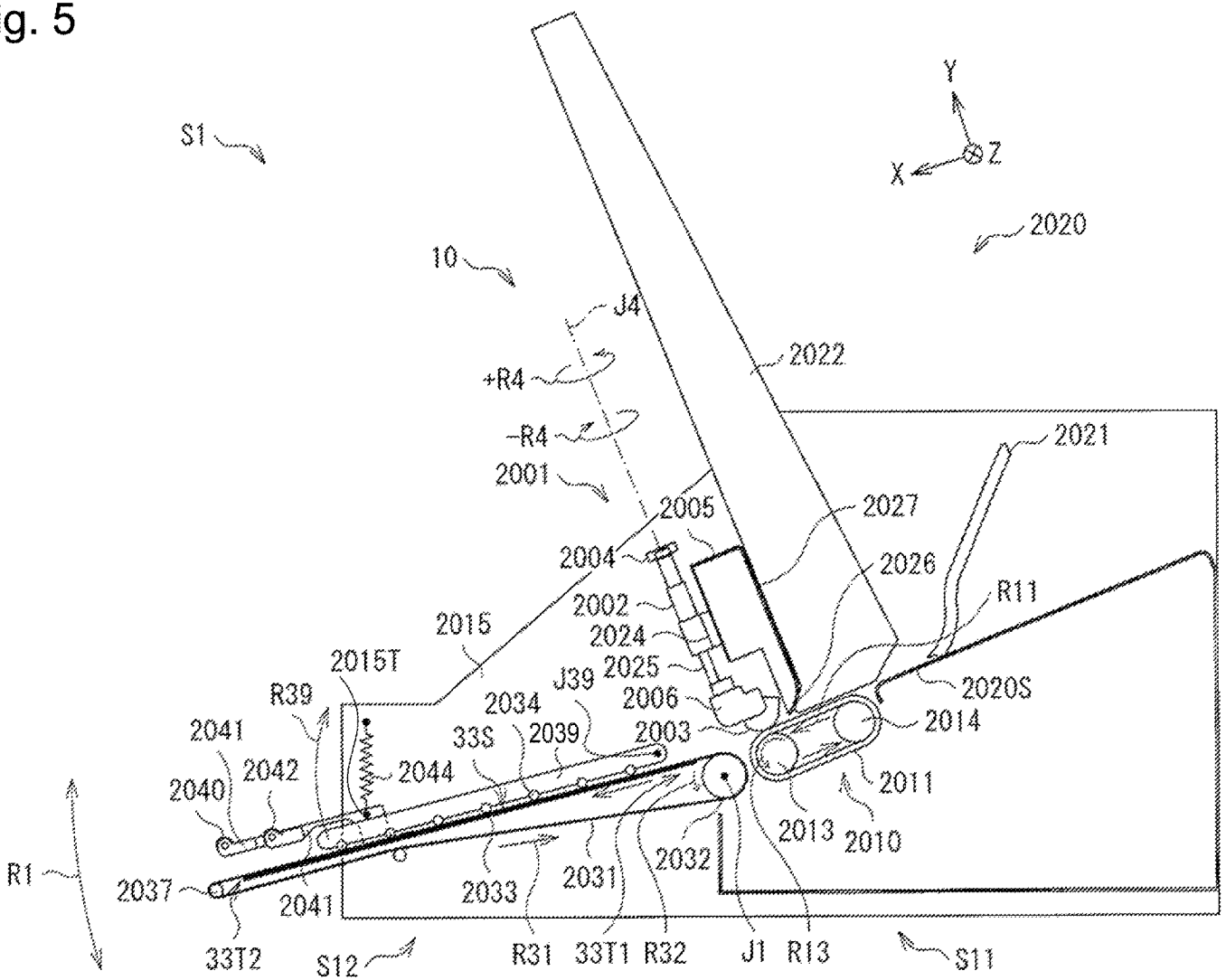
FIG. 5 is a magnified schematic view illustrating the medium feeder illustrated in FIG. 1.

FIG. 5 is a magnified front view illustrating a main part of medium feeder S1. Incidentally, in this specification, a transport direction of transport of media PM1 is referred to as an X-axis direction. Furthermore, a width direction of media PM1 which is orthogonal to the X-axis direction is referred to as a Z-axis direction, and a direction orthogonal to the main surfaces of media PM1 is referred to as a Y-axis direction.

Medium separator S11 includes bridge 2005 in addition to stacker 2020 and separation part 10, which are discussed above. Stacker 2020 and separation part 10 are adjacently arranged with bridge 2005 interposed in between. Stacker 2020 and separation part 10 are attached to bridge 2005.

(Configuration of Stacker 2020)

Stacker 2020, for example, includes: bottom plate 2020S which supports stacked media PM1 from below; stack guide 2021 which guides the rear ends of stacked media PM1; and set guides 2022 which guides the side ends of media PM1.

(Configuration of Separation Part 10)

Separation part 10 includes separation section 2001 and feed transport section 2010.

(Separation Section 2001)

Separation section 2001 includes separation frame 2002, separator 2003, knob 2004, separator frame 2006 and support 2025. Separation frame 2002 is fixed to bridge 2005 with the assistance of connector 2024, and holds support 2025 movable in the Y-axis direction. As illustrated in FIG. 5, knob 2004 is held by separation frame 2002 so as to be rotatable about axis J4 in +R4 and −R4 directions, and functions as an operation part which operates the movement of support 2025 in the Y-axis direction. Support 2025 is a member extending in the Y-axis direction. Support 2025, for example, moves in the +Y direction in response to the turn of knob 2004 in the +R direction, and moves in the −Y direction in response to the turn of knob 2004 in the −R direction. When support 2025 moves in the +Y direction, part or all of support 2025 enters into separation frame 2002. Meanwhile, when support 2025 moves in the −Y direction, part or all of support 2025, which has been inside separation frame 2002, comes out of separation frame 2002 (in a direction opposite to knob 2004). Separator frame 2006 is connected to a distal end of support 2025, that is, an opposite end portion of support 2025 from separation frame 2002. Separator 2003 is provided to an opposite side of separator frame 2006 from support 2025. Separator 2003 is provided facing feed transport section 2010, and includes a contact surface which comes into contact with media PM1 when medium separator S11 performs a medium separation operation. This configuration makes support 2025, separator frame 2006 and separator 2003 integrally movable in the +Y or −Y direction in response to the turn of knob 2004. Incidentally, in the embodiment, the +Y direction is referred to as an upward direction, and the −Y direction is referred to as a downward direction, in some cases. Separator 2003 does not come into direct or indirect contact with a surface of feed belt 2011, and is displaceable such that a height position (Y-axis direction position) of the contact surface of separator 2003 is located lower than a height position of the surface of feed belt 2011.

(Feed Transport Section 2010)

Feed transport section 2010 is located lower than stacker 2020 and separation section 2001, and includes, for example, feed belt 2011, medium sensor 2012, drive roller 2013 and stretch roller 2014. Feed belt 2011 is an endless belt member stretched by drive roller 2013 and stretch roller 2014 which both extend in the Z-axis direction. Drive force is transmitted to drive roller 2013 from drive motor S1M which drives under the control of controller SS1, and thus, drive roller 2013 rotationally drives in an arrow R13 direction (FIG. 5). The rotation of drive roller 2013 makes feed belt 2011 circularly rotate in a direction indicated with arrow R11. Frictional force between stretch roller 2014 and feed belt 2011 makes stretch roller 2014 rotate in response to feed belt 2011. Medium sensor 2012 (FIG. 1) detects whether media PM1 are stacked on stacker 2020.

(Configuration of Bridge 2005)

Moreover, bridge 2005 includes: load guide 2027 which comes into contact with front end surfaces of media PM1 (see FIG. 1) stacked on stacker 2020; and preliminary movement guide 2026 located lower than load guide 2027. Load guide 2027 includes, for example, a flat surface extending in the Y-axis direction, while preliminary movement guide 2026 includes a curve surface which becomes gradually closer to separation section 2001. Preliminary movement guide 2026 functions to make media PM1 advance slightly further in the +X direction (downstream direction) as media PM1 advances further downward (becomes closer to feed belt 2011).

(Configuration of Medium Transport Apparatus S12)

As illustrated in FIGS. 3 and 5, medium transport apparatus S12 includes, for example, transport belt 2031, drive roller 2032, transport table 2033, transport rollers 2034, medium sensors 2035, 2036 (FIG. 1), stretch roller 2037 and transport roller frame 2039, in addition to frame 2015.

Transport table 2033 is a member on which media PM1 are placed after separated by medium separator S11, and which guides thus-placed media PM1 to image formation apparatus S2. Transport table 2033 is a flat plate-shaped member which, for example, includes: placement surface 33S extending on the X-Z plane; end portion 33T1 located upstream: and end portion 33T2 located downstream. Transport table 2033 is provided turnable about shaft portion J1 (FIG. 5) which is parallel to placement surface 33S, for example, in an arrow R1 direction (FIG. 5). Shaft portion J1 is a specific example corresponding to a "first shaft portion" in one or more embodiments. For example, the two ends of shaft portion J1 is fixed to frame 2015.

Drive roller 2032 is a rotor arranged adjacent to, near, or close to end portion 33T1 of transport table 2033, and is a specific example corresponding to a "first rotor" in one or more embodiments. Drive force is transmitted to drive roller 2032 from drive motor S1M which drives under the control of controller SS1, and thus, drive roller 2032 rotationally drives about shaft portion J1, which extends in the Z-axis direction, in an arrow R32 direction (FIG. 5).

Stretch roller 2037 is a rotor arranged adjacent to, near, or close to end portion 33T2 of transport table 2033, and is a specific example corresponding to a "second rotor" in one or more embodiments. Stretch roller 2037 is located in a distal end portion of medium transport apparatus S12. When medium transport apparatus S12 is attached to attached part 600, stretch roller 2037 is inserted into opening 650 of attached part 600.

Transport belt 2031 is an endless belt member stretched by drive roller 2032 and stretch roller 2037 so as to surround part of transport table 2033 or pass above placement surface 33S. Rotation of drive roller 2032 circularly rotates transport belt 2031 in a direction indicated with arrow R31 (FIG. 5). Thus, transport belt 2031 transports media PM1 in the +X direction from the upstream to the downstream. Incidentally, frictional force between stretch roller 2037 and transport belt 2031 makes stretch roller 2037 rotate in response to transport belt 2031.

Furthermore, transport rollers 2034 are rotors which rotate, for example, about their axes each extending in the Z-axis direction, and are provided along the transport direction of media PM1 (X-axis direction) while facing transport belt 2031 and transport table 2033. Transport rollers 2034 rotate in response to the circular rotation of transport belt 2031 with medium PM1 held between transport rollers 2034 and transport belt 2031. Thereby, transport rollers 2034 transport medium PM1 to image formation apparatus S2. Transport roller frame 2039 holds respective transport rollers 2034 rotatable. Frame 2015 holds transport roller frame 2039 movable. Endmost transport roller 2034, which is the closest to end portion 33T2, is movable to be away from transport belt 2031 (or placement surface 33S). More specifically, for example, frame 2015 holds transport roller frame 2039 so that transport roller frame 2039 can turn in an arrow R39 direction about rotational shaft J39 provided to a rear end portion of transport roller frame 2039 (FIG. 5). Rotational shaft J39 extends in the Z-axis direction, and its two ends are fixed to frame 2015. Each of transport rollers 2034 is a specific example corresponding to an "auxiliary roller" in one or more embodiments, and transport roller frame 2039 is a specific example corresponding to a "support" in one or more embodiments.

Medium sensor 2035 is provided adjacent to, near, or close to a distal end of feed transport section 2010 (adjacent to, near, or close to stretch roller 2037). Medium sensor 2036 is provided in a middle position (between drive roller 2032 and stretch roller 2037) in the X-axis direction.

Medium transport apparatus S12 further includes a pair of first guide rollers 2040 and a pair of second guide rollers 2042 which are provided at positions on transport table 2033 different from one another in both the X-axis direction and the Z-axis direction. For example, first guide rollers 2040 are provided respectively to two ends of transport table 2033 in the Z-axis direction. Second guide rollers 2042 are provided between first guide rollers 2040 and are located next to each other in the Z-axis direction. First guide rollers 2040 are provided to a pair of frames 2041 which are fixed to transport table 2033. Second guide rollers 2042 are provided to frame 2043 which links the pair of frames 2041 together.

Medium transport apparatus S12 further includes biasing part 2044. Biasing part 2044 links or connects frame 2015 and attachment part 2015T provided between end portion 33T2 and shaft portion J1 in transport table 2033, and thereby urges transport table 2033 upward. In other words, transport table 2033 includes attachment part 2015T provided between second end portion 33T2 and end portion 33T1 in X-axis direction. Biasing part 2044 connecting frame 2015 and attachment part 2015T biases transport table 2033 in a longitudinal direction of biasing part 2044. Biasing part 2044 is, for example, an elastic member such as a coil spring or a leaf spring. Hung by biasing part 2044, transport table 2033 is elastically turnable about shaft portion J1.

[1.3 Detailed Configuration of Image Formation Apparatus S2]

Next, referring to FIG. 1, descriptions are provided for a configuration of image formation apparatus S2. Image formation apparatus S2 corresponds to a specific example of an "image formation apparatus" in one or more embodiments, and is, for example, a printer which forms an image (for example, a color image) on medium PM1, PM2 such as a paper sheet and a film, which serve as materials to be printed on, by use of an electrophotographic method. Inside housing K, image formation apparatus S2 includes medium feed device 100, transport device 300, image formation device 400, attached part 600, intermediate transfer device 700, fixation device 500, delivery device 800, reverse device 900, controller SS2, and drive motor S2M. Controller SS2 controls the entirety of image formation apparatus S2 in cooperation with controller SS1 in medium feeder S1. Based on an instruction from controller SS2, drive motor S2M serves as a drive source for the entirety. Image formation apparatus S2 is configured such that medium transport apparatus S12 is attachable to and detachable from attached part 600.

(Medium Feed Device 100)

Medium feed device 100 includes feed tray 101, placement board 102, lift-up lever 103, motor 104, elevation detector 201, pickup roller 202, feed roller 203 and retard roller 204.

Feed tray 101, for example, is detachably attached to a lower part of image formation apparatus S2, contains media PM2 as stacked, and is provided with placement board 102 so that placement board 102 is turnable about shaft J102. Some of media PM2 are stacked on placement board 102. Lift-up lever 103, which is supported turnable by shaft J103, is provided to a feed-out side of feed tray 101 from which media PM2 are fed out. Drive force from motor 104 rotates shaft J103. For example, based on a signal from controller SS2, motor 104 operates and stops. In medium feed device 100 like this, lift-up lever 103 turns about shaft J103; thereby, a distal end portion of lift-up lever 103 pushes placement board 102 upward; and media PM2 placed on placement board 102 also rise. This configuration makes sure that the upper surface of the uppermost one of media PM2 is in contact with pickup roller 202. Elevation detector 201 detects that placement board 102 is elevated sufficiently up to a predetermined height and the upper surface of the uppermost one of media PM2 comes into contact with pickup roller 202. Based on a signal from elevation detector 201, controller SS2 stops the drive of motor 104. Pickup roller 202, feed roller 203 and retard roller 204 jointly function as a print medium feed-out section which feeds media PM2, contained in feed tray 101, to transport device 300 on a one-by-one basis. Pickup roller 202 and feed roller 203 are rotationally driven in their respective arrow directions illustrated in FIG. 1.

(Attached Part 600)

Figure 6:
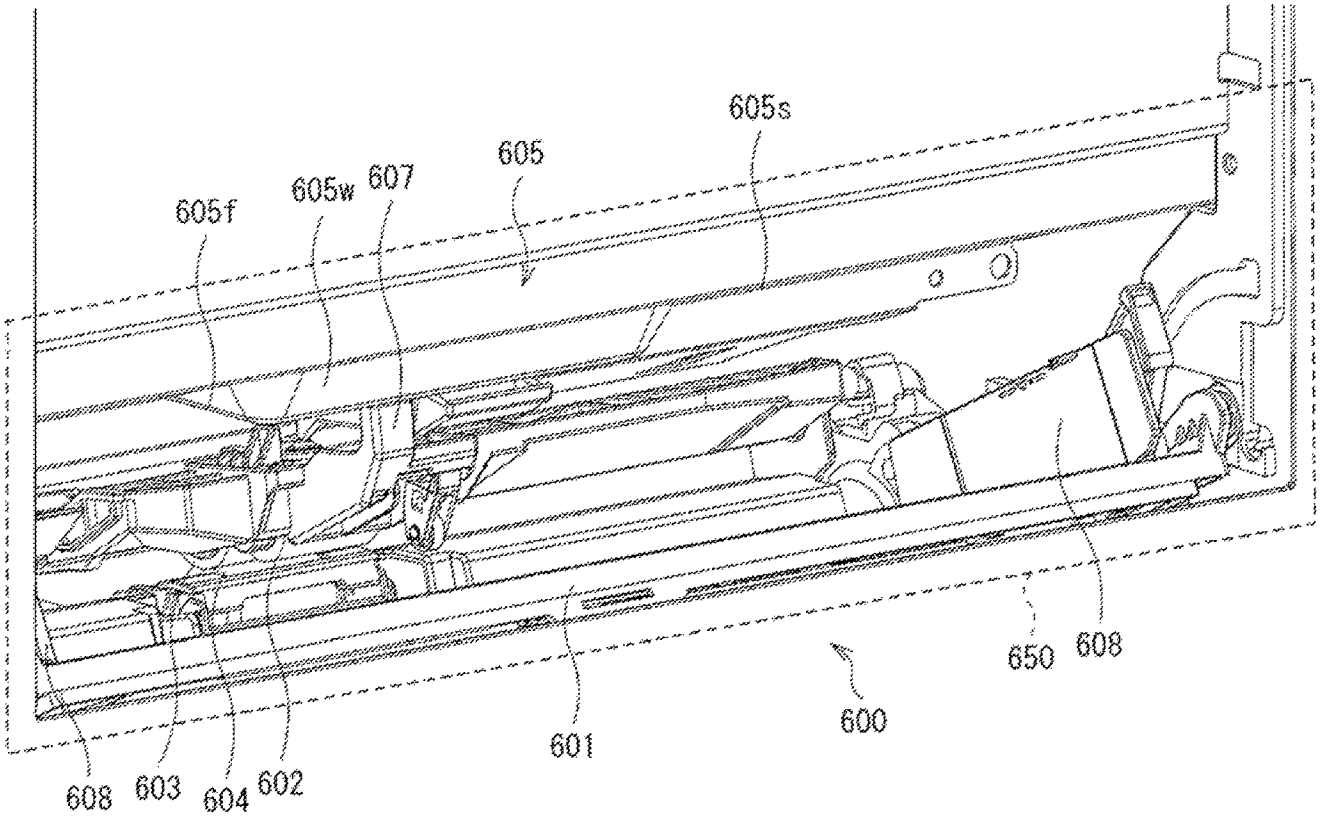
FIG. 6 is a magnified perspective view illustrating an attached part of the image formation apparatus illustrated in FIG. 4.
Figure 7:
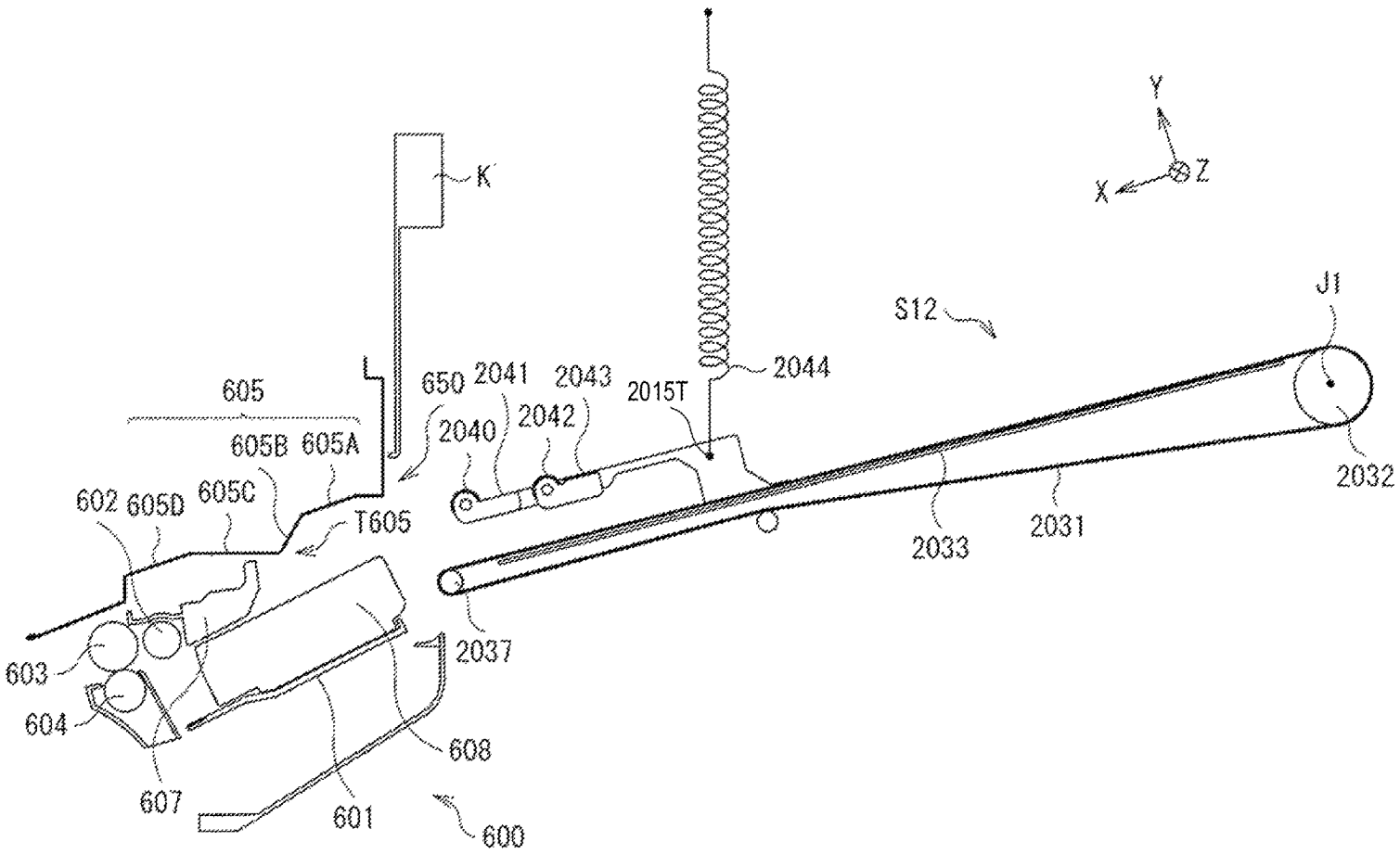
FIG. 7 is a schematic cross-sectional view illustrating a structure of the attached part of the image formation apparatus illustrated in FIG. 4.
Figure 8:
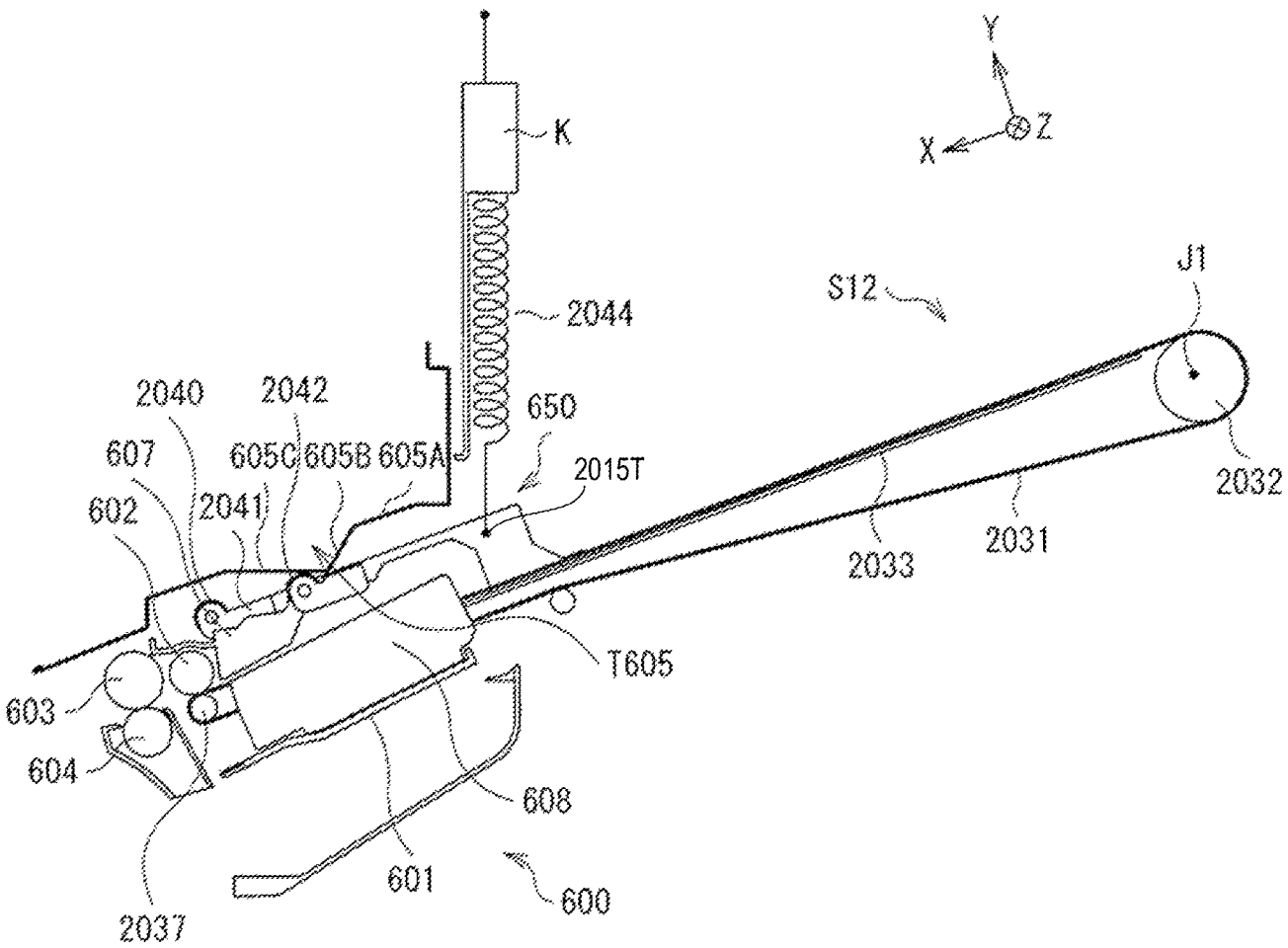
FIG. 8 is a schematic cross-sectional view illustrating how a medium transport apparatus is attached to the attached part of the image formation apparatus illustrated in FIG. 4.

Attached part 600 receives medium PM1 transported from medium transport apparatus S12 in medium feeder S1, and includes opening 650 provided in the side surface of housing K. FIG. 6 illustrates an external appearance of attached part 600 in a magnified way. FIG. 7 illustrates medium transport apparatus S12 detached away from attached part 600. FIG. 8 illustrates medium transport apparatus S12 attached to attached part 600. Attached part 600 as a whole has a recess portion such that a distal end of medium transport apparatus S12, inserted through opening 650, is attachable to and detachable from attached part 600. Attached part 600 includes: guide surface 605 serving as the ceiling surface of the recess portion; medium load plate 601 serving as the bottom surface of the recess portion; and a pair of guide plates 608 serving as the side surfaces of the recess portion. Feed roller 603 and retard roller 604 are provided in the most downstream portion of attached part 600. Pickup roller 602, which is supported rotatable by frame 607, is provided before feed roller 603. Pickup roller 602, feed roller 603 and retard roller 604 jointly function as a print medium feed-out section which feeds media PM1, transported from medium transport apparatus S12, to transport device 300 on a one-by-one basis.

Guide surface 605 guides first guide rollers 2040 and second guide rollers 2042 to the deep of attached part 600 while biasing first guide rollers 2040 and second guide rollers 2042 downward. Guide surface 605 includes slope portion 605A, slope portion 605B, flat surface portion 605C and slope portion 605D in this order from opening 650 to the downstream. Slope portion 605B and flat surface portion 605C jointly form protrusion T605. Protrusion T605 is provided only in a middle portion between the pair of second guide rollers 2042 in the width direction of medium PM1 (in the Z-axis direction). Thus, when medium transport apparatus S12 is attached to attached part 600, the pair of first guide rollers 2040 do not come into contact with protrusion T605, and only the pair of second guide rollers 2042 come into contact with protrusion T605.

It should be noted that pickup rollers 202, 602 and feed rollers 203, 603 each may include, for example, a built-in one-way clutch mechanism such that the rollers are idly rotatable in the directions indicated with the arrows, respectively. Furthermore, using rotational torque generators, retard rollers 204, 604 generate rotational torque in their respective arrow directions illustrated in FIG. 1, respectively.

(Transport Device 300)

Transport device 300 is a mechanism which transports media PM2 from medium feed device 100, or media PM1 from medium transport apparatus S12, to a transfer device on a one-by-one basis. Transport device 300 includes, for example, medium sensor 301, transport roller pair 302, medium sensor 303, transport roller pair 304, medium thickness sensor 320, medium sensor 330, and transport roller pair 305 which are arranged in this order from the upstream to the downstream. Transport roller pairs 302, 304, 305 transport medium PM1, PM2 to the downstream while restricting the skew of medium PM1, PM2 or preventing medium PM1, PM2 from taking an oblique course. Medium PM1 from attached part 600 flow into the transport passage at an area between transport roller pair 302 and transport roller pair 304. Medium sensors 301, 303, 330 detect the positions of medium PM1, PM2 in order to adjust timings of driving transport roller pairs 302, 304, 305.

(Image Formation Device 400)

Image formation device 400 includes, for example, image formation units 400Y, 400M, 400C, 400K. Using their corresponding color toners, that is, a yellow toner, a magenta toner, a cyan toner and a black toner, image formation units 400Y, 400M, 400C, 400K form their respective color toner images, which are specific examples of a developer image.

Image formation units 400Y, 400M, 400C, 400K each include, for example, photosensitive drum 401, charge roller 402, light emitting diode (LED) head 850, development roller 404, cleaning part 405, toner containers 406Y, 406M, 406C, 406K, and supply roller 407. Charge roller 402, development roller 404 and supply roller 407 jointly form a development unit, and work under the control of controller SS2.

Photosensitive drum 401 is a column-shaped member which carries an electrostatic latent image on its surface (surface part), and which extends in the Z-axis direction. Photosensitive drum 401 includes a photoreceptor (for example, an organic photoreceptor). More specifically, photosensitive drum 401 includes a conductive support, and a photoconductive layer covering the circumference (surface) of the conductive support. The conductive support is formed, for example, from a metal pipe which is made of aluminum. The photoconductive layer has, for example, a structure in which a charge generation layer and a charge transport layer are stacked sequentially. Photosensitive drum 401 like this rotates at a predetermined circumferential speed (in this example, rotates counterclockwise as indicated with the corresponding arrow in FIG. 1) based on an instruction from controller SS2.

Charge roller 402 is a member (charge member) which electrically charges the surface (surface part) of photosensitive drum 401, and which is arranged in contact with the surface (circumferential surface) of photosensitive drum 401. Charge roller 402 includes, for example, a metal shaft, and a semi-conductive rubber layer (for example, a semi-conductive epichlorohydrin rubber layer) covering the circumference (surface) of the metal shaft. In this example, charge roller 402 rotates clockwise (rotates in a direction opposite to the direction in which photosensitive drum 401 rotates).

Development roller 404 is a member that carries the toner, which is used to develop the electrostatic latent image, on its surface. Development roller 404 is arranged in contact with the surface (circumferential surface) of photosensitive drum 401. Development roller 404 includes, for example, a metal shaft, and a semi-conductive urethane rubber layer covering the circumference (surface) of the metal shaft. Development roller 404 like this rotates at a predetermined circumferential speed (in this example, rotates clockwise, that is, in the direction opposite to the direction in which photosensitive drum 401 rotates).

Toner containers 406Y, 406M, 406C, 406K respectively contain the yellow toner, the magenta toner, the cyan toner and the black toner, as well as supply the respective color toners to corresponding supply rollers 407 depending on the necessity.

Each of supply rollers 407 is a member (supply member) which supplies the color toner to development roller 404, and are arranged in contact with the surface (circumferential surfaces) of development roller 404. Supply roller 407 includes, for example, a metal shaft, and a foamed silicone rubber layer covering the circumference (surface) of the metal shaft. In this example, supply roller 407 rotates clockwise (rotates in the same direction as development roller 404 rotates).

Each LED head 850 is a light exposure device which forms electrostatic latent images on the surface (surface part) of photosensitive drum 401 by exposing the surface of photosensitive drum 401 to light. Each LED head 850 includes light emitting portions which are in charge of corresponding photosensitive drum 401, and which are arranged in the Z-axis direction. Each LED head 850 includes, for example, a light source such as a light emitting diode which emits irradiation light, and a lens array which forms an image of the irradiation light on the surface of photosensitive drum 401.

Cleaning part 405 removes toner which remains on the surface of photosensitive drum 401 after a toner image is transferred onto medium PM1, PM2.

(Intermediate Transfer Device 700)

Intermediate transfer device 700 is also termed an intermediate transfer belt unit, and includes intermediate transfer belt 701, drive roller 702, driven roller 703, backup roller 704, primary transfer rollers 705Y, 705M, 705C, 705K, cleaner 706, secondary transfer roller 707, and biasing part 708. Drive roller 702, driven roller 703, backup roller 704, primary transfer rollers 705Y, 705M, 705C, 705K, and secondary transfer roller 707 are substantially column-shaped members, which are rotatable about their respective rotational shaft portions extending in the Z-axis direction vertical to paper sheet surfaces. Intermediate transfer device 700 is a mechanism which transports medium PM1, PM2, transported from transport roller pair 305, in the transport direction, and which transfers the toner images, formed by image formation units 400Y, 400M, 400C, 400K, onto intermediate transfer belt 701 sequentially in the transport direction.

Intermediate transfer belt 701 is, for example, an endless elastic belt made of a resin material such as polyimide resin. Intermediate transfer belt 701 is provided stretched (suspended stretched) by drive roller 702, driven roller 703 and backup roller 704.

Motive power which is transmitted to drive roller 702 from drive motor S2M controlled by controller SS2 rotates drive roller 702 clockwise in the arrow direction illustrated in FIG. 1. Thereby, drive roller 702 makes intermediate transfer belt 701 circularly rotate in a direction which is the same as rotation direction R701. Drive roller 702 is arranged upstream of image formation units 400Y, 400M, 400C, 400K in rotation direction R701 of intermediate transfer belt 701. Depending on biasing force produced by biasing part 708, driven roller 703 adjusts tension to be applied to intermediate transfer belt 701. Driven roller 703 rotates in a direction which is the same as rotation direction R701, and is arranged downstream of image formation units 400Y, 400M, 400C, 400K in rotation direction R701. Drive roller 702, driven roller 703 and biasing part 708 jointly form a drive mechanism which drives intermediate transfer belt 701. Cleaner 706 is a member which cleans intermediate transfer belt 701 by scraping toners which adhere to the transferred surface of intermediate transfer belt 701.

Secondary transfer roller 707 and backup roller 704 jointly form secondary transfer section 750. Secondary transfer roller 707 and backup roller 704 are arranged facing each other with intermediate transfer belt 701 interposed in between. Secondary transfer roller 707 includes, for example, a metal core, and an elastic layer, such as a foamed rubber layer, formed by being wound around the circumferential surface of the metal core. A biasing part, such as a coil spring, whose one end is fixed to housing K or the like of image formation apparatus S2 biases secondary transfer roller 707 toward backup roller 704. Thereby, secondary transfer roller 707 is pressed against backup roller 704 with intermediate transfer belt 701 interposed in between.

When backup roller 704 and secondary transfer roller 707 transfer (secondarily transfer) toner images on intermediate transfer belt 701 onto medium PM1, PM2 supplied from transport roller pair 305, a DC voltage is applied to secondary transfer roller 707 to generate a potential difference between secondary transfer roller 707 and backup roller 704.

(Configuration of Fixation Device 500)

Fixation device 500 is a member to apply heat and pressure to the toner images transferred on medium PM1, PM2 having passed secondary transfer section 750 which includes secondary transfer roller 707 and backup roller 704, as well as to thereby fix the toner images to medium PM1, PM2. Fixation device 500 includes upper roller 501 and lower roller 502, as illustrated in FIG. 1.

Upper roller 501 and lower roller 502 include heat sources 503A, 503B, which are heaters such as halogen lamps, therein, respectively. Upper roller 501 and lower roller 502 function as heat rollers which apply heat to the toner images on medium PM1, PM2. For example, upper roller 501 is rotationally driven by drive motor S2M controlled by controller SS2. Heat sources 503A, 503B are supplied with bias voltages controlled by controller SS2, and thus control the surface temperatures of upper roller 501 and lower roller 502, respectively.

Lower roller 502 is arranged facing upper roller 501 so as to form a press-contact portion between lower roller 502 and upper roller 501. Lower roller 502 functions as a pressure roller which applies pressure to the toner images on medium PM1, PM2. Lower roller 502 may include a surface layer made of an elastic material.

(Delivery Device 800)

Delivery device 800 includes, for example, transport roller pairs 801 to 804, and stacker 805. Thus, when delivery separator 901 (described later) is oriented as illustrated in FIG. 1, medium PM1, PM2 having been sent out from fixation device 500 is transported sequentially by transport roller pairs 801 to 804 to the outside, and is stacked on stacker 805. Incidentally, delivery port 510 may be additionally provided downstream of transport roller pair 801 so that transport roller pair 504 delivers medium PM1, PM2 through delivery port 510. In this case, delivery separator 507 is provided in order to select from the transport passage bound for transport roller pair 802 and the transport passage bound for transport roller pair 504.

(Reverse Device 900)

Reverse Device 900 is a mechanism which, after the images are formed on the surface of medium PM1, PM2, forms a transport passage for guiding medium PM1, PM2 from transport roller pair 305 to secondary transfer section 750 and fixation device 500 once again in order to form images on the back surface of medium PM1, PM2. Reverse device 900 includes delivery separator 901, reverse roller pair 902, reverse separator 903, guide part 904, transport roller pairs 905 to 907 and evacuation part 914.

When delivery separator 901 is switched, for example, into a switch-back orientation indicated with dashed lines in FIG. 1, medium PM1, PM2 having been delivered from fixation device 500 moves in an arrow B direction due to the rotations of reverse roller pair 902, and is guided to evacuation part 914. Thereafter, reverse separator 903 turns, and reverse roller pair 902 rotate reversely. Thereby, medium PM1, PM2 having been accommodated in evacuation part 914 moves in an arrow C direction. Transport roller pairs 905 to 907 make medium PM1, PM2 further move through guide part 904. Thereafter, medium PM1, PM2 is guided to the transport passage before transport roller pair 305, and is sent out by transport roller pair 305 into secondary transfer section 750 once again. The mechanism like this makes it possible to print the both sides of medium PM1, PM2.

[1.4 Working/Effects of Image Formation System]

(A. Basic Operation)

The image formation system transfers toner images onto medium PM1, PM2 in the following way.

Once print image data is inputted into activated image formation apparatus S2 from an external apparatus, controller SS2 starts an operation of printing the print image data.

More specifically, controller SS2 drives intermediate transfer belt 701 and each photosensitive drum 401, as well as makes each charge roller 402 start a charge operation. In addition, controller SS2 sends a light-exposure control signal to each LED head 850. At a timing specified by the light-exposure control signal, LED head 850 irradiates photosensitive drum 401 with light corresponding to a color component of a print image, and thereby forms an electrostatic latent image on the surface of photosensitive drum 401. Development roller 404 forms a toner image as a developer image in the corresponding one of yellow (Y), magenta (M), cyan (C) and black (B) by sticking a corresponding developer to the electrostatic latent image on photosensitive drum 401. A power supply circuit in controller SS2 applies transfer biases to primary transfer rollers 705Y, 705M, 705C, 705K. Thus, primary transfer rollers 705Y, 705M, 705C, 705K sequentially transfer the toner images on photosensitive drums 401 onto the transferred surface of intermediate transfer belt 701, and thereby superimpose the toner images.

Subsequently, controller SS2 rotates pickup rollers 202, 602 and feed rollers 203, 603, as well as makes medium feeder S1 start to supply medium PM1, PM2 by sending a control signal to controller SS1 in medium feeder S1. Thereby, medium PM1, PM2 is supplied to transport device 300 at a predetermined transport speed. More specifically, the supply of media PM2 is achieved as follows. As illustrated in FIG. 1, to begin with, pickup roller 202 picks up uppermost medium PM2 from media PM2 contained in feed tray 101 on a one-by-one basis, and sends out medium PM2 to feed roller 203. Subsequently, feed roller 203 and retard roller 204 corrects the skewing or obliqueness of medium PM2 having been sent out from feed tray 101. After that, medium PM2 is transported to secondary transfer section 750 via transport device 300. Descriptions are later provided for how media PM1 is supplied in details.

For example, once medium sensor 330 detects the position of medium PM1, PM2, medium sensor 330 sends a detection signal to controller SS2. Controller SS2 adjusts the transport speed of medium PM1, PM2 and the rotation speed of intermediate transfer belt 701, and thus aligns medium PM1, PM2 with the toner images on intermediate transfer belt 701. Thereby, at a secondary transfer position, that is, at a position where backup roller 704 and secondary transfer roller 707 face each other, the toner images on intermediate transfer belt 701 are secondarily transferred onto predetermined areas on medium PM1, PM2. Thereafter, fixation device 500 applies heat and pressure to the toner images having been transferred onto medium PM1, PM2, and thus fixes the toner images to medium PM1, PM2. Eventually, transport roller pairs 801 to 804 and the like in delivery device 800 deliver medium PM1, PM2 with the toner images fixed thereto to the outside, and medium PM1, PM2 is accumulated on stacker 805.

(B. Attachment Operation of Medium Feeder S1)

Figure 9:
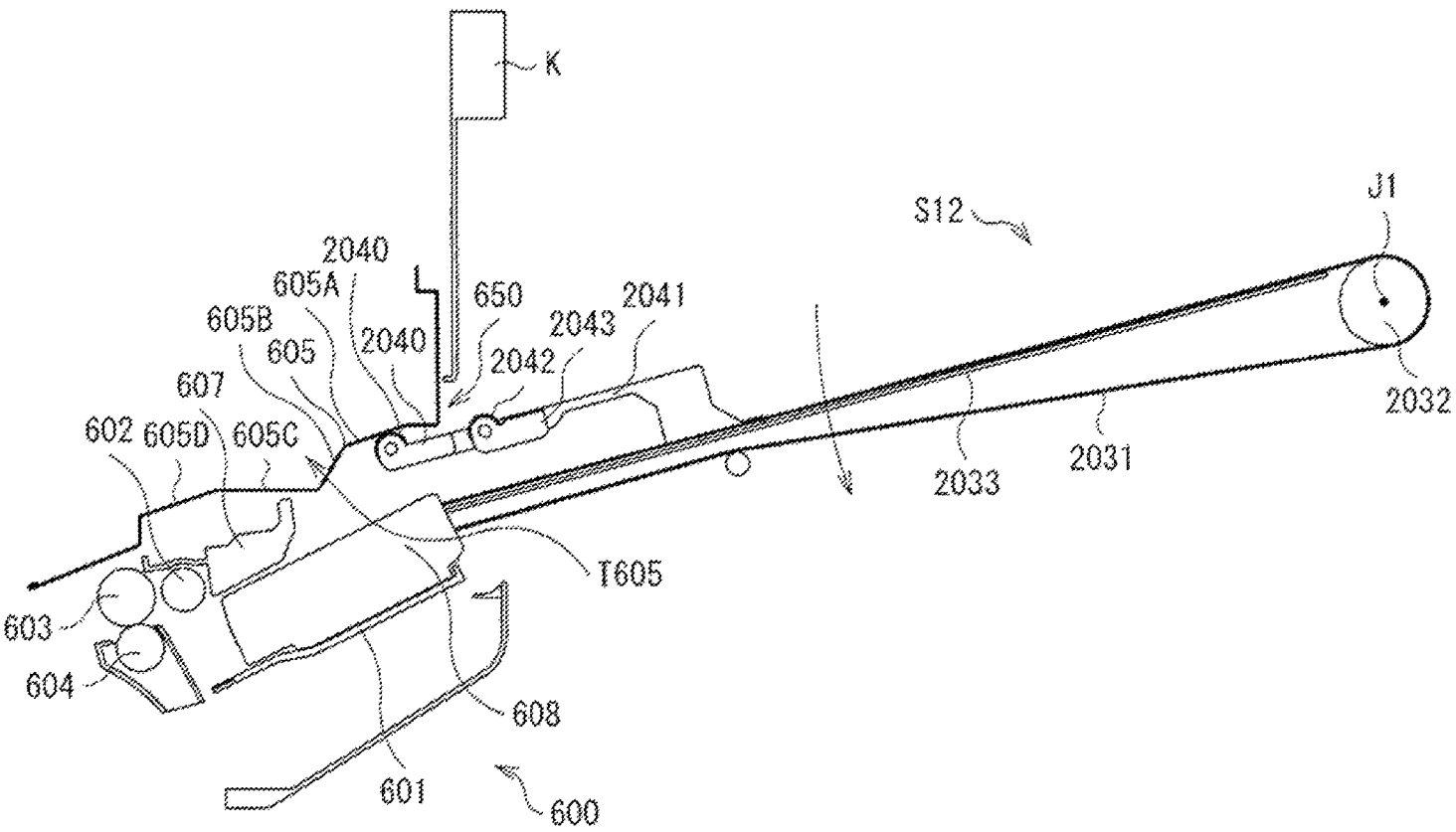
FIG. 9 is a first cross-sectional view illustrating how to attach the medium transport apparatus to the image formation apparatus in the image formation system illustrated in FIG. 1.
Figure 10:
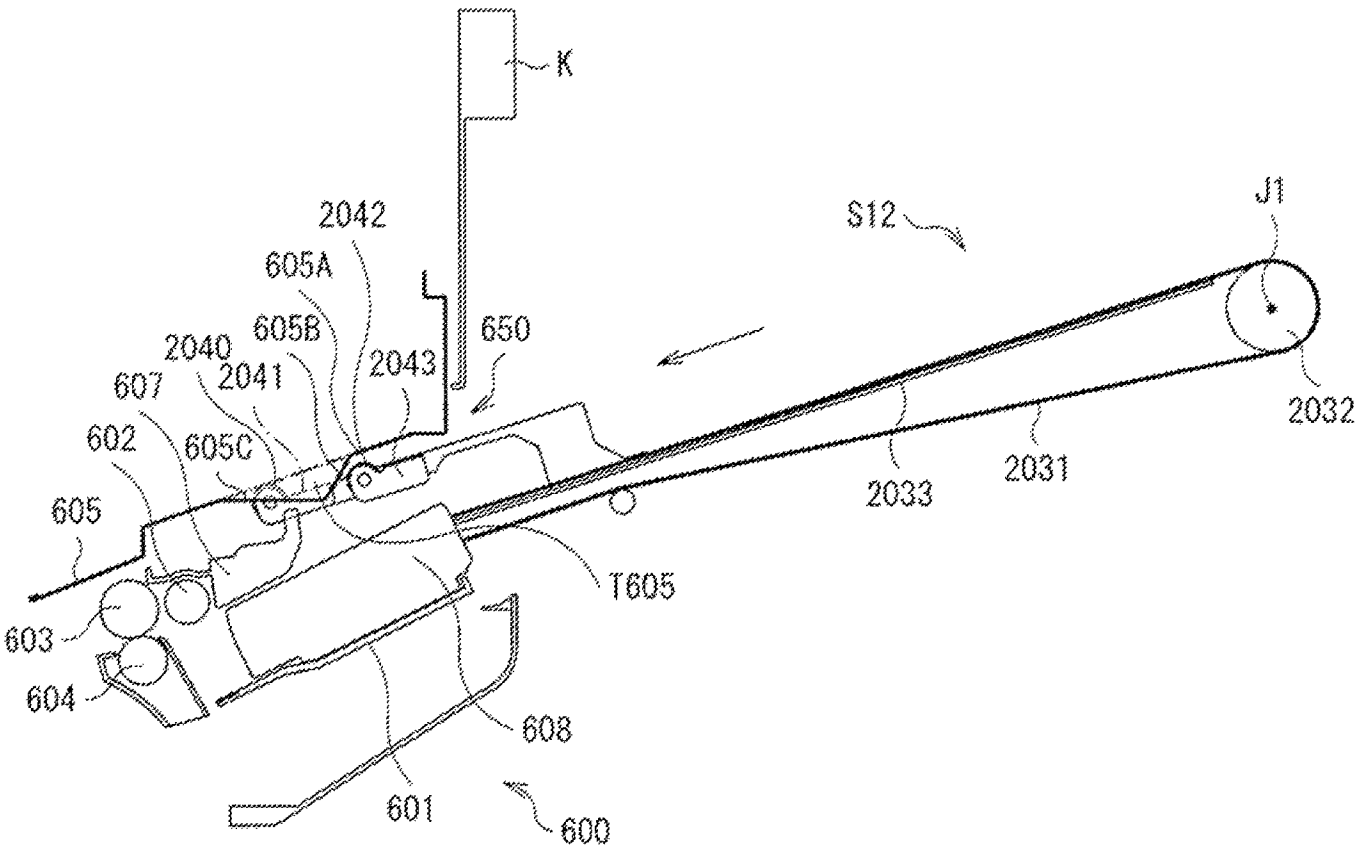
FIG. 10 is a second cross-sectional view illustrating how to attach the medium transport apparatus to the image formation apparatus in the image formation system illustrated in FIG. 1.
Figure 11:
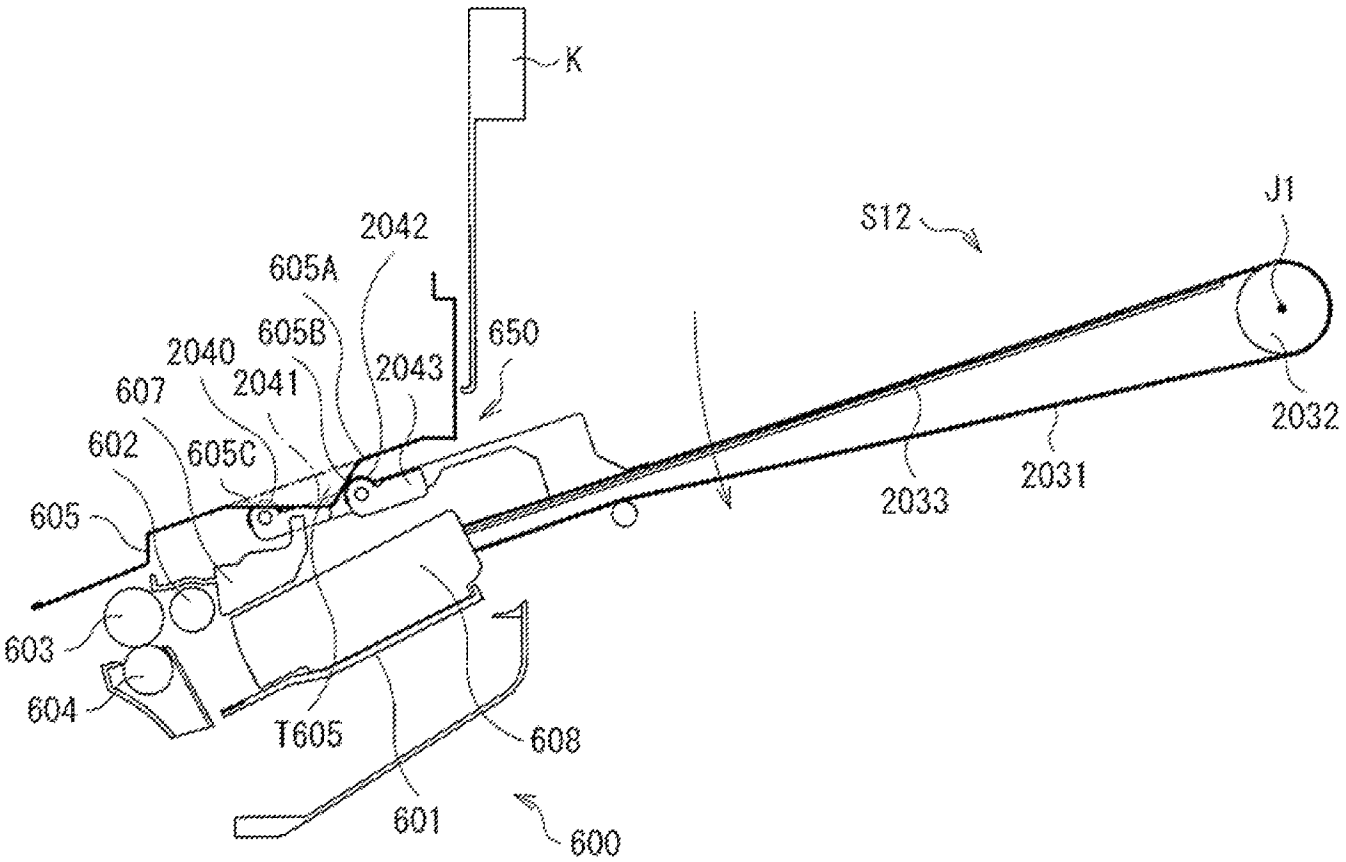
FIG. 11 is a third cross-sectional view illustrating how to attach the medium transport apparatus to the image formation apparatus in the image formation system illustrated in FIG. 1.

Next, referring to FIGS. 9 to 11 in addition to FIGS. 7 and 8, descriptions are provided for how to attach medium feeder S1 to image formation apparatus S2. In this case, the distal end portion of medium transport apparatus S12 is inserted into attached part 600 of image formation apparatus S2 by moving medium feeder S1 in the horizontal direction. Before starting the attachment operation, the height position of the distal end portion of medium transport apparatus S12 is made to roughly agree with the height position of attached part 600 of image formation apparatus S2 by adjusting the height of stand section 2016.

As illustrated in FIG. 7, to begin with, the distal end portion of medium transport apparatus S12, that is, the vicinity of stretch roller 2037, is brought closer to opening 650 of attached part 600. To this end, the height position of the vicinity of stretch roller 2037 is finely adjusted by manually lifting and pressing down transport table 2033 so that first guide rollers 2040 come closer to guide surface 605. Since transport table 2033 is hung from frame 12 by biasing part 2044, workload on the user is lighter. For this reason, the user can perform the fine adjustment relatively easily.

Next, as illustrated in FIG. 9, the distal end portion of medium transport apparatus S12 is inserted into attached part 600 via opening 650 so that first guide rollers 2040 come into contact with guide surface 605. Thereafter, medium feeder S1 is moved horizontally with first guide rollers 2040 in contact with guide surface 605. Thereby, first guide rollers 2040 are guided along the shape of guide surface 605. While first guide rollers 2040 are being guided along the shape of guide surface 605, first guide rollers 2040 are pressed gradually downward due to their contact with slope portion 605A. Thus, medium transport apparatus S12 turns about shaft portion J1 so that stretch roller 2037 descends. Continued insertion of medium transport apparatus S12 brings second guide rollers 2042 closer to slope portion 605B which forms protrusion T605, as illustrated in FIG. 10. Eventually, as illustrated in FIG. 11, second guide rollers 2042 come into contact with slope portion 605B whose gradient is larger than that of slope portion 605A. Thus, medium transport apparatus S12 further turns about shaft portion J1 so that stretch roller 2037 descends. Thereafter, as illustrated in FIG. 8, second guide rollers 2042 moves over protrusion T605, and comes into contact with flat surface portion 605C. Thereby, medium transport apparatus S12 is locked. Thus, stretch roller 2037 is located right under pickup roller 602. With this, the attachment operation of medium transport apparatus S12 comes to an end.

(C. Operation of Medium Feeder S1)

Next, referring to FIGS. 1 to 5, descriptions are provided for how medium feeder S1 works. For example, media PM1 such as envelopes are stacked on stacker 2020. Media PM1 are stacked thereon with the rear end portions of media PM1 lifted by stack guide 2021. Thereby, the weight of media PM1 is distributed. Furthermore, with their front end portions in contact with set guides 2022, media PM1 are set thereon so as to be prevented from moving downstream. While in the state, upon receipt of a control signal from controller SS2 of image formation apparatus S2, controller SS1 drives drive motor S1M if medium sensor 2012 provided under stacker 2020 detects loaded media PM1 whereas at least either medium sensor 2035 or medium sensor 2036 detects no media PM1. Even when medium sensor 2012 detects media PM1, controller SS1 does not drive drive motor S1M if both medium sensor 2035 and medium sensor 2036 detect media PM1. Furthermore, it is a matter of course that controller SS1 does not drive drive motor S1M when medium sensor 2012 detects no media PM1.

The drive of drive motor S1M rotationally drives drive roller 2013 in the arrow R13 direction (FIG. 5). The rotational drive of drive roller 2013 makes feed belt 2011 circularly rotate in the direction indicated with arrow R11 (FIG. 5). Thereby, medium PM1, which is located the lowest among media PM1 stacked on stacker 2020, is sent out in the +X direction. There is a case, however, where because of frictional forces between them, some of media PM1 are sent out in the +X direction while remaining stacked together. One or more sent-out media PM1 enter the interstice between preliminary movement guide 2026 and feed belt 2011. The function of preliminary movement guide 2026 reduces the number of media PM1 to move downstream at a time to one or two. One or more media PM1 move in the +X direction, wiggling under separator 2003 while contacting contact surface 2003S of separator 2003. If media PM1 reaches separator 2003 while remaining stacked together, separator 2003 allows only lowermost medium PM1 to wiggle under separator 2003, and stops upper media PM1. Because of this behavior, separation section 2001 separates only medium PM1 from media PM1, and sends out medium PM1 to medium transport apparatus S12 located downstream of separation section 2001.

The drive of drive motor S1M rotationally drives drive roller 2032 in the arrow R32 direction (FIG. 5). The rotational drive of drive roller 2032 circularly rotates transport belt 2031 in the direction indicated with arrow R31 (FIG. 5). Thereby, medium PM1, reaching medium transport apparatus S12 after separated by medium separator S11, is transported in the +X direction over transport table 2033 due to frictional force produced between medium PM1 and transport belt 2031. Once medium sensor 2035 detects the front end portion of medium PM1, drive motor S1M stops. This stops the operation of transporting medium PM1. When the transport operation stops, it is desirable that the front end portion of medium PM1 be located downstream of a nip section between pickup roller 602 and transport belt 2031. After that, under the control of controller SS2 in image formation apparatus S2, pickup roller 602 rotates, and medium PM1 is transported further downstream. Once medium sensor 2036 detects that the rear end portion of medium PM1 passes over medium sensor 2036, the drive of drive motor S1M resumes, and medium feeder S1 thus starts to perform a feed operation on new medium PM1.

(D. Working/Effects of Image Formation System)

As discussed above, in the embodiment, biasing part 2044 biases the part of transfer table 2033 upward in medium feeder S1. For this reason, even if transport table 2033 is bulky in size and weight, medium transport apparatus S12, including transport table 2033, can be attached to attached part 600 of image formation apparatus S2 relatively easily while avoiding medium transport apparatus S12, including transport table 2033, unnecessarily colliding with guide plates 608, medium load plate 601 and the like in attached part 600. In other words, medium transport apparatus S12 (medium feeder S1) of the embodiment can be attached to image formation apparatus S2 smoothly.

Particularly in the embodiment, since guide surface 605 in attached part 600 guides first guide rollers 2040 and second guide rollers 2042 while biasing first guide rollers 2040 and second guide rollers 2042 downward, medium transport apparatus S12 imposes no excessive load on medium load plate 601 or the like in attached part 600.

In contrast to this, if the structure were, for example, such that first guide rollers 2040 and second guide rollers 2042 are biased and guided upward by medium load plate 601 and the like while contacting medium load plate 601 and the like, medium load plate 601 and the like would likely be deformed (warped) by the weight of medium transport apparatus S12 in a case where transport table 2033 is very heavy. Accordingly, attached part 600 would likely deteriorate quickly, and the accurate guide would likely be hindered. With these taken into consideration, it is more desirable that, like in the embodiment, first guide rollers 2040 and second guide rollers 2042 be biased and guided downward by guide surface 605 located above first guide rollers 2040 and second guide rollers 2042 while contacting guide surface 605.

Modifications

Although described using embodiments, the invention is not limited to the foregoing embodiment, and can be modified variously. For example, although the foregoing embodiment has described the image formation apparatus which forms a color image, the invention is not limited to this. The image formation apparatus may be, for example, one which forms a monochrome image by transferring only a black toner image. Furthermore, although the foregoing embodiment has described the image formation apparatus which performs the secondary transfer, the invention is also applicable to an image formation apparatus which performs primary transfer (direct transfer).

Moreover, although in the foregoing embodiment, transport table 2033 is hung from the side wall portion of frame 2015 by biasing part 2044, the invention is not limited to this mode. Transport table 2033 may be, for example, pushed upward by biasing part 2044 from below.

Besides, although in the foregoing embodiment and the like, both the table (transport table 2033) and the first rotor (drive roller 2032) rotate about the first shaft portion (shaft portion J1), the invention is not limited to this. The table (transport table 2033) and the first rotor (drive roller 2032) may rotate about their respective shaft portions which are different from each other. What is more, the positions of drive roller 2032 and stretch roller 2037 may be swapped for each other so that transport table 2033 and stretch roller 2037 rotate about the same rotational shaft portion.

In addition, although in the foregoing embodiment and the like, the LED heads each using the light emitting diode as the light source are used as the light exposure devices, the light exposure devices each may use, for example, a laser device or the like as the light source instead.

Furthermore, although the foregoing embodiment and the like have described the image formation apparatus including the print function which is a specific example of the "image formation apparatus" in one or more embodiments, the "image formation apparatus" is not limited to this. In other words, the invention is applicable to an image formation apparatus to function as a multi-function printer which, for example, has a scan function and a facsimile function in addition to such a print function.

The invention claimed is:

1. A medium transport apparatus comprising:
- a frame;
- a table comprising a placement surface on which a medium is placed, a first end portion, and a second end portion, the table extending from the first end portion to the second end portion and being rotatable about a first shaft portion parallel to the placement surface;
- a first rotor arranged adjacent to the first end portion of the table;
- a second rotor arranged adjacent to the second end portion of the table;
- a belt that is stretched by the first rotor and the second rotor, and is configured to rotate circularly and to transport the medium in a first direction from the first end portion toward the second end portion;
- a biasing part that links the frame and an attachment part provided between the second end portion and the first end portion of the table, and that biases the table upward; and
- a guide portion that guides the table to turn in a condition in which the medium transport apparatus detachably attaches to an attached part of an image formation apparatus, wherein
- the guide portion comes into contact with and is pressed downward by a guide surface of the attached part against biasing force produced by the biasing part in the condition in which the medium transport apparatus detachably attaches to the attached part of the image formation apparatus.

2. The medium transport apparatus according to claim 1, wherein the first rotor rotates about the first shaft portion.

3. The medium transport apparatus according to claim 1, wherein the first shaft portion is fixed to the frame.

4. The medium transport apparatus according to claim 1, wherein the guide portion is provided on the table.

5. The medium transport apparatus according to claim 1, wherein the guide portion comprises a first guide portion and a second guide portion provided on the table at positions different from each other both in the first direction and in a second direction orthogonal to the first direction.

6. The medium transport apparatus according to claim 5, wherein the first guide portion and the second guide portion are provided on the table above the placement surface.

7. The medium transport apparatus according to claim 1, further comprising one or more auxiliary rollers facing the belt.

8. The medium transport apparatus according to claim 7, wherein
- the auxiliary rollers are arranged in the first direction, and are held rotatable by a support, and
- the support is held by the frame and turnable about a rotational shaft, and
- the endmost one of the auxiliary rollers, which is the closest to the second end portion, is movable to be away from the belt.

9. The medium transport apparatus according to claim 1, wherein the belt circularly rotates while passing above the placement surface.

10. The medium transport apparatus according to claim 1, wherein
- the guide portion comprises a first guide portion and a second guide portion provided on the table at positions different from each other both in the first direction and in a second direction orthogonal to the first direction, and
- the guide surface of the attached part comprises:
  - a first contact portion configured to come contact with the first guide portion; and
  - a second contact portion configured to come contact with the second guide portion.

11. The medium transport apparatus according to claim 1, wherein the guide portion comprises a roller.

12. An image formation system comprising:
- a medium feeder; and
- an image formation apparatus, wherein
- the medium feeder comprises:
  - a medium separator comprising:
    - a stacker that holds media as stacked one on another; and
    - a separation part that separates a medium from the media on a one-by-one basis; and
  - a medium transport apparatus that transports the medium separated from the media by the medium separator,
- the medium transport apparatus comprises:
  - a frame;
  - a table comprising a placement surface on which the medium is placed, a first end portion and a second end portion, the table extending from the first end portion to the second end portion and being rotatable about a first shaft portion parallel to the placement surface;
  - a first rotor arranged adjacent to the first end portion of the table;
  - a second rotor arranged adjacent to the second end portion of the table;
  - a belt that is stretched by the first rotor and the second rotor, and is configured to rotate circularly and to transport the medium in a first direction from the first end portion toward the second end portion;

a biasing part that links the frame and an attachment part located between the second end portion and the first end portion in the table and which biases the table upward; and a first guide portion and a second guide portion provided on the table at positions different from each other both in the first direction and in a second direction orthogonal to the first direction, the image formation apparatus comprises an attached part to which the medium transport apparatus is detachably attachable, and the attached part comprises a guide surface in contact with at least one of the first guide portion and the second guide portion.

13. The image formation system according to claim 12, wherein the attached part comprises a lock portion which locks the first guide portion or the second guide portion.

14. The image formation system according to claim 12, wherein the guide surface guides the first guide portion and the second guide portion while biasing the first guide portion and the second guide portion downward against biasing force produced by the biasing part in a condition in which the medium transport apparatus detachably attaches to the attached part of the image formation apparatus.

15. The image formation system according to claim 12, wherein the first guide portion comprises a roller, and the second guide portion comprises a roller.

16. An image formation system comprising:

a medium feeder; and an image formation apparatus, wherein the medium feeder comprises:

a medium separator comprising:

a stacker that holds media as stacked one on another; and a separation part that separates a medium from the media on a one-by-one basis; and a medium transport apparatus that transports the medium separated from the media by the medium separator, the image formation apparatus comprises an attached part to which the medium transport apparatus is detachably attachable, the medium transport apparatus comprises:

a frame;

a table comprising a placement surface on which the medium is placed, a first end portion and a second end portion, the table extending from the first end portion to the second end portion and being rotatable about a first shaft portion parallel to the placement surface;

a first rotor arranged adjacent to the first end portion of the table;

a second rotor arranged adjacent to the second end portion of the table;

a belt that is stretched by the first rotor and the second rotor, and is configured to rotate circularly and to transport the medium in a first direction from the first end portion toward the second end portion;

a biasing part that links the frame and an attachment part located between the second end portion and the first end portion in the table and which biases the table upward; and a guide portion that guides the table to turn in a condition in which the medium transport apparatus detachably attaches to an attached part of an image formation apparatus, the attached part comprises a guide surface which guides the guide portion while pressing the guide portion downward against biasing force produced by the biasing part.

* * * * *